US012253345B2

(12) United States Patent
Tiffany et al.

(10) Patent No.: US 12,253,345 B2
(45) Date of Patent: Mar. 18, 2025

(54) ACCURATE, LOW RECOIL SHOTSHELL

(71) Applicants: John R. Tiffany, Hudson, OH (US); Kerry L. Tiffany, Hudson, OH (US)

(72) Inventors: John R. Tiffany, Hudson, OH (US); Kerry L. Tiffany, Hudson, OH (US)

( * ) Notice: Subject to any disclaimer, the term of this patent is extended or adjusted under 35 U.S.C. 154(b) by 0 days.

(21) Appl. No.: 18/512,226

(22) Filed: Nov. 17, 2023

(65) Prior Publication Data

US 2024/0401921 A1 Dec. 5, 2024

Related U.S. Application Data

(60) Provisional application No. 63/469,484, filed on May 29, 2023.

(51) Int. Cl.
*F42B 7/04* (2006.01)
*F42B 7/08* (2006.01)

(52) U.S. Cl.
CPC ..... *F42B 7/046* (2013.01); *F42B 7/08* (2013.01)

(58) Field of Classification Search
CPC .. F42B 7/043; F42B 7/046; F42B 7/06; F42B 7/08
USPC ..... 102/518, 519, 522, 523, 532, 703, 451
See application file for complete search history.

(56) References Cited

U.S. PATENT DOCUMENTS 2,766,692 A * 10/1956 Mynes ..... F42B 7/08 102/506
3,598,057 A * 8/1971 Potter ..... F42B 12/64 102/460
3,602,143 A * 8/1971 Critcher ..... F42B 7/08 102/449
3,669,023 A 6/1972 Moehlman
3,670,650 A 6/1972 Mccaffrey
3,726,231 A 4/1973 Kelly
3,835,783 A 9/1974 Curran
4,212,244 A * 7/1980 Flatau ..... F42B 5/03 102/438
4,479,438 A * 10/1984 Bilsbury ..... F42B 7/08 102/452
4,733,611 A * 3/1988 Janay ..... F42B 5/03 102/501
5,005,483 A * 4/1991 Deffayet ..... F42B 12/60 102/357
5,225,628 A * 7/1993 Heiny ..... F42B 7/10 102/438

(Continued)

FOREIGN PATENT DOCUMENTS

AU 2010208155 B2 12/2014
CA 2609664 C 1/2015

*Primary Examiner* — John Cooper
(74) *Attorney, Agent, or Firm* — Renner, Otto, Boisselle, & Sklar, LLP.

(57) ABSTRACT

A shotshell comprising a casing having a top end and bottom end, and a longitudinal axis that runs from the top end to the bottom end; a base disposed at and sealing the bottom end of the casing; a propellant disposed toward the bottom end of the casing, above the base; a primer set into the base and in contact with the propellant; a wad disposed above the propellant; a plurality of shot pellets; a payload carrier disposed between the wad and the top end of the casing, the payload carrier comprising one or more longitudinal chambers, each chamber configured to store a portion of the plurality of shot pellets in a single file column aligned parallel to the longitudinal axis of the casing.

11 Claims, 14 Drawing Sheets

(56) References Cited

U.S. PATENT DOCUMENTS

| | | | | |
|---|---|---|---|---|
| 5,648,637 | A * | 7/1997 | Clark, III | F42B 5/03 102/491 |
| 5,817,969 | A * | 10/1998 | Ettmuller | F42B 12/60 102/494 |
| 7,302,892 | B1 | 12/2007 | Meyer | |
| 7,360,491 | B2 | 4/2008 | Sanborn | |
| 7,503,261 | B2 * | 3/2009 | Burri | F42B 12/06 102/504 |
| 8,807,040 | B2 | 8/2014 | Menefee | |
| 9,207,050 | B2 * | 12/2015 | Sorensen | F42B 7/10 |
| 10,422,611 | B1 | 9/2019 | Moser | |
| 10,466,023 | B2 * | 11/2019 | Garst | F42B 7/046 |
| 10,584,947 | B1 | 3/2020 | Manley | |
| 11,236,980 | B2 * | 2/2022 | Thuman | F42B 12/60 |
| 11,248,889 | B1 | 2/2022 | Eerden | |
| 2011/0185936 | A1 * | 8/2011 | Richardson | F42B 12/36 102/438 |
| 2014/0130696 | A1 * | 5/2014 | DeJong | F42B 7/10 102/448 |
| 2014/0130697 | A1 * | 5/2014 | DeJong | F42B 7/08 102/450 |
| 2019/0093997 | A1 | 3/2019 | Billings | |
| 2019/0301844 | A1 | 10/2019 | Garst | |
| 2021/0140747 | A1 | 5/2021 | Mcdevitt | |
| 2021/0348897 | A1 | 11/2021 | Salat | |
| 2022/0236024 | A1 | 7/2022 | Dixon | |
| 2022/0282959 | A1 | 9/2022 | Mcleod | |

* cited by examiner

ACCURATE, LOW RECOIL SHOTSHELL

CROSS-REFERENCE TO RELATED APPLICATIONS

This application claims the benefit of U.S. Provisional Patent Application No. 63/469,484, filed May 29, 2023, which is hereby incorporated herein by reference in its entirety.

BACKGROUND OF THE INVENTION

Hunters, sports shooters, police, and military personnel fire shotguns that use or employ shot, snakeshot, bulleted shotshells, or other subcaliber projectiles at animals, sports targets, hostile personnel, or drones, often without achieving the desired destructive effect. The desired effect is for one or more subcaliber projectiles or shot to strike a target with sufficient energy to damage or destroy it. The desired effect is often not achieved because 1) the subcaliber projectiles, also referred to as "shot," disperse broadly after escaping the weapon muzzle, causing few or none of the elements of shot to strike the intended target, or 2) the subcaliber projectiles, while in the barrel of the firing platform and prior to exiting the muzzle, become mixed with the expanding gases of the detonated cartridge and do not achieve the higher velocity expected or required of a single, larger projectile or bullet that grips the rifling or sides of the barrel, capturing gases behind it and causing the force of the gases to more efficiently propel the projectile, or 3) the subcaliber projectiles, while in the barrel of the firing platform and prior to exiting the muzzle, ricochet off of each other and off of the internal surfaces of the firing platform barrel and, if any, the rifling of the firing platform barrel, causing the subcaliber projectiles to scatter erratically once they have exited the muzzle of the firing platform. The shot escapes the muzzle at a lesser velocity than a bullet would, and, being smaller and lighter than a bullet, loses velocity more rapidly than a bullet, so that contact, if any, with a target does not have sufficient energy to be destructive.

Most of the subcaliber projectiles, also called shot, that are fired at a target do not hit the target. The shot disperses in a broad, generally circular pattern. Shotgun enthusiasts often "pattern" their shotguns, that is, they place a circular target a fixed distance from the shotgun and fire one round at the target, then count the shot that hit a circle in the center of the target and the shot that hit outside the circle. Depending mostly on the distance to the target, the type of cartridge or shell fired, and the modifications to the barrel of the shotgun, it is typical for zero to thirty percent of the shot to hit the center circle. Patterning is important to turkey hunters who aim for the head of a turkey. They desire to hit the head of the animal, but do not desire for shot to hit the body of the animal because that shot must be removed, otherwise, it can be a problem when the turkey is cooked and eaten.

Sports shooters desire to hit a flying target with sufficient force to break the object in flight. The shot that does not hit the target is wasted. The shot that missed the target served only to increase weight of ammunition and increase felt recoil of the firing platform on the shoulder of the shooter. A sports shooter would prefer to place all of the shot in one small pattern at or within close vicinity to the target and eliminate the wasted shot.

Shotguns are often used in home defense situations. Stray shot can miss an intruder and damage the house or hit other occupants. Shotguns have considerable recoil, making them hard to use for elderly or users of small stature.

BRIEF SUMMARY OF THE INVENTION

The invention relates to a shotshell comprising a casing having a top end and bottom end, and a longitudinal axis that runs from the top end to the bottom end; a base disposed at and sealing the bottom end of the casing; a propellant disposed toward the bottom end of the casing, above the base; a primer set into the base and in contact with the propellant; a wad disposed above the propellant; a plurality of shot pellets; a payload carrier disposed between the wad and the top end of the casing, the payload carrier comprising one or more longitudinal chambers, each chamber configured to store a portion of the plurality of shot pellets in a single file column aligned parallel to the longitudinal axis of the casing.

When the shotshell is inserted into a firearm and fired, the primer ignites the propellant, forcing the wad, payload carrier, and shot out of a muzzle of the firearm, wherein, after exiting the muzzle, the shot exit the payload carrier through open ends of the chambers, outrun the payload carrier, and follow a ballistic trajectory downrange.

The shotshell may include each of the one or more longitudinal chambers have a distal open end disposed toward the top end of the casing and a proximal open end disposed toward the propellant.

The shotshell may include each of the one or more longitudinal chambers have a distal open end disposed toward the top end of the casing and a proximal closed end disposed toward the propellant.

The shotshell may include the plurality of shot pellets comprises pellets of varying diameters.

The shotshell may include the one or more longitudinal chambers comprise one chamber.

The shotshell may include the one or more longitudinal chambers comprise two or more chambers.

The shotshell may include the one or more longitudinal chambers have a cross-sectional shape selected from circular, triangular, square, hexagonal, and octagonal.

The shotshell may include a hollow bullet disposed between the payload carrier and the top end of the casing.

The shotshell may include the payload carrier is nonlethal.

The shotshell may include the shot pellets comprise less-than-lethal pellets.

The shotshell may include the wad and payload carrier comprise a single unit.

An alternate embodiment may be a cartridge comprising a casing having a top end and bottom end; a hollowed bullet disposed in and sealing the top end of the casing; a base disposed at and sealing the bottom end of the casing; a propellant disposed toward the bottom end of the casing, above the base; a primer set into the base and in contact with the propellant; an overpowder card disposed above the propellant; a plurality of shot pellets; a payload carrier disposed between the overpowder card and extending into the hollowed bullet, the payload carrier comprising one or more longitudinal chambers, each chamber sized to store a portion of the plurality of shot pellets in a single file column aligned parallel to a longitudinal axis of the casing.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DETAILED DESCRIPTION

Figure 1:
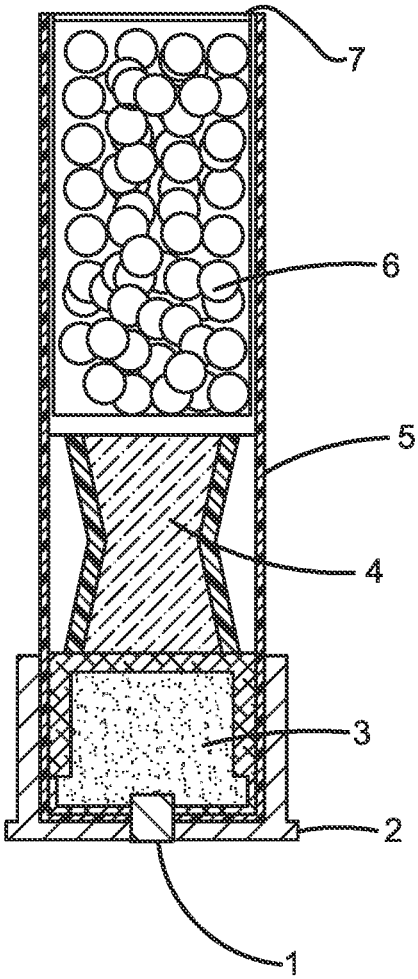
FIG. 1 Prior Art
FIG. 1 is a side cross-sectional view of a standard shotshell.

The present invention is directed to improved shotshells that have greater accuracy and reduced recoil over traditional shotshells.

Existing methods for propelling subcaliber shotgun munitions toward a target allow at least four shortcomings. These are: 1) excessive shot dispersion, 2) low shot velocity, 3) weapon barrel damage due to shot peening in the barrel, and 4) heavy recoil.

1) Excessive shot dispersion. Shotgun shells and bulleted shotshells both cause a quantity of (usually) spherical projectiles to be propelled from chamber to muzzle as a propellant (also known as powder, gunpowder, or smokeless powder) burns, resulting in rapidly expanding gases. The shot may be initially contained within a hollow bullet or may be initially contained within a plastic or fiber cup (the wad). In either configuration, when a weapon is fired, the expanding gases flash from the chambered cartridge or shell toward the muzzle of the weapon. The bullet, shot, and/or wad are forcefully propelled by the gases, which, despite the design or structure of the bullet or wad, mix with the shot and other material in the barrel causing turbulence that affects the performance of the objects leaving the muzzle. When gases mix with shot, the shot ricochets off the internal sides of the barrel and any other material in the barrel, which includes other shot. Like billiard balls struck by a fast-moving billiard ball, the shot collides with other shot and with the barrel. Shot that is made of soft lead tends to flatten or crush as it strikes the barrel or other shot. Steel or plated shot flattens and crushes less, but causes greater damage to the barrel. When the shot finally exits the muzzle of the weapon, the billiard ball effect causes immediate broad dispersion. Some or most of the shot travels along a path directly forward of the barrel, but the billiard ball effect continues in flight, resulting in a broad pattern or broad shot dispersion. A choke placed in the barrel or attached to the muzzle can slightly "tighten" the shot pattern, but it does not negate the billiard ball effect. On exiting from the muzzle, the flight of the projectiles is consistently influenced by the erratic paths of shot that were present within the barrel.

2) Low shot velocity. Capturing expanding gases in the controlled detonation that occurs with firing a firearm is an enduring problem. Historically, persons who fired cannon, mortars, muskets, black powder shotguns, rifles, and pistols have wrapped, packed, or padded projectiles in leather, cloth, soft lead, metal foil, paper, or any available, pliable material in hopes of forcing expanding gases to push, rather than bypass, projectiles. Modern solutions replace the leather, cloth, and other materials, with plastic or precisely cut metal cups or sheets, which are usually referred to as the "wad" or "wads," which improve performance, but increase difficulty in loading, interfere with projectile trajectory consistency, and/or fail to fully seal the gaps between the projectile or projectiles and the metal containments of the barrel. Gases that bypass the materials that are intended to trap the gases mix with shot; some gases bypass the shot and actually push backward on the shot, though the general effect is to propel the shot forward. The end result of leaking gases is reduced shot velocity.

3) Barrel peening. Shot that mixes with gases bounces off other shot and the internal walls of the barrel. Damage to the barrel depends on the shot construction. Soft lead shot causes little damage but is seldom used due to environmental concerns and because the shot, which usually starts off being spherical, is flattened or rolled into eccentric shapes as it ricochets down the barrel. Shot that is not spherical flies erratically, making the shot grouping wider than patterns made when shot is spherical. Non-spherical shot also flies slower, leading to striking an eventual target with less energy. To overcome shot flattening or misshaping, manufacturers plate the lead shot with a hard metal or simply use a hard metal to make shot. When the metal or the plating is hard, barrel damage increases.

4) Shotguns inherently have a heavy recoil. Shotguns are desirable for home defense because they do not require high level of skill to injure or kill an intruder or assailant at close range. In contrast with a handgun or rifle, the bullet can miss the target, leaving the user vulnerable to the intruder or assailant. The recoil of the handgun or rifle can be exacerbated when used by an elderly user, or a user of small stature. The broad shot pattern of the fired shot often ensures that the target is hit with some shot, even if the user's aim is off, whether due to inexperience, small stature, or age. For this reason, shotguns can be desirable for elderly or users of small stature, but the heavy recoil makes them less desirable because it can cause serious injury to such users.

The present invention is directed to an improved shotshell that has greater accuracy and reduced recoil over traditional shotshells. The shotshell includes a payload carrier that reduces dispersion of shot or other subcaliber projectiles fired from a shotgun, rifle, pistol, or larger bore gun. The payload carrier is a structure with several aligned tubes, pipettes, channels, or chambers (these terms are intended to be used interchangeably and have the same meaning) that are longitudinally aligned or parallel to the central longitudinal axis of the shotshell, bullet, or cartridge. Each chamber is slightly wider than the diameter of the subcaliber projectile or shot that is loaded into the payload carrier. The shot are able to freely slide within the chamber unless restricted by other adjacent subcaliber projectiles in the chamber or by the wad at the base end or the sealed top of the casing. The payload carrier is designed to contain the shot or subcaliber devices until it exits the muzzle of the firearm. The payload carrier and contained shot then separate and the shot continues forward. The chambers are designed so there is minimal or no friction on the shot or subcaliber devices, so it can freely and easily exit the chambers. Containing the shot from the firing chamber to the muzzle reduces or eliminates occurrence of shot or subcaliber device bouncing or ricocheting off other shot or the internal wall of the barrel. Thus, the broad dispersion of shot or subcaliber devices as the shot exit the muzzle is reduced.

The alignment of the subcaliber projectiles or shot directs the kinetic energy of the subcaliber projectiles and directs the trajectory of the subcaliber projectiles along or in parallel to the central longitudinal axis of the cartridge or shotshell and the barrel of the firing platform. When the firing platform is a shotgun or cannon, the payload carrier, after exiting the muzzle of the firing platform, separates from the shot or subcaliber devices due to inertia and/or air resistance creating a greater aerodynamic drag on the payload carrier than on the shot. The dense subcaliber projectiles or shot, having greater mass than the payload carrier, decelerate at a slightly lesser rate than the payload carrier, and separate from the payload carrier, while continuing to move forward along the same trajectory.

The payload carrier can accommodate chambers of varying diameter to hold shot of varying diameter. The present invention is not limited to any particular size or gauge of shot or shotgun, and can be modified to fit various configurations of barrel size, shot pellet size, number of pellets, etc. The shot pellets may be of different diameters in a single shell, so long as each chamber contains only pellets of only one diameter and so long as the pellets, constrained by the diameter of the containing tube, are constrained to be in single file aligned along the longitudinal axis of the shell. This arrangement can also accommodate different less-than-lethal payloads, alone or in combination, such as rock salt, pepper balls, paint/stain balls, rubber shot, for home defense or riot control. The payload carrier can be nonlethal as well.

In another embodiment, the wad and payload carrier are a single, integral unit.

In another embodiment, the payload carrier comprises a hollow bullet. When fired in a shotshell bullet, the payload carrier is used with a dense, hollow bullet. On detonation, the bullet-payload carrier travels from the firing platform chamber to the muzzle as a single unit. When they exit the muzzle, the bullet, being denser than the payload carrier, outruns the shot. This embodiment can comprise a hollow bullet with a separate payload carrier inserted into the underside/back of the bullet. (See FIG. 8A) (This will be referred to as a 3-part bullet: bullet+payload carrier+shot). In another embodiment, the bullet can comprise a bullet itself as the payload carrier, wherein the bullet has a series of holes in its back/underside that hold shot. (See FIG. 8) (This embodiment will be referred to as a 2-part bullet: bullet+shot). In the 2-part bullet embodiment, when the bullet has a hard metal shell and a lead fill, the lead often distorts with the force of propellent detonation and holds on to the shot. To counter this, stiffer metal (e.g. brass) pipettes are inserted into each hole then shot is added to each pipette.

The payload carrier is designed to ensure that the shot achieves the same velocity as the enclosing payload carrier, to ensure that the pattern of the shot exhibits low dispersion, and to provide an increased number of projectiles striking the intended target with reduced recoil. Use of the payload carrier results in fewer shot pellets, which results in lighter shell, which results in reduced recoil. In alternate embodiments, the payload carrier can be reduced in length and additional propellant added, which results in higher velocity shot, but also increased recoil.

This payload carrier design contrasts notably to the containment methods for shot in shotgun shells and in bulleted shotshells where shot is poured or packed into available space and individual shot pellets, which are not under constant physical constraint, roll about or collide with other shot pellets and the internal barrel wall in every available direction.

Referring now to the drawings, FIG. 1 shows a cross section of a standard shotshell. The essential parts of the shotshell are the primer 1, the metal base 2, the propellant 3, the crushable wad 4, the hull or casing 5, the metal shot or pellets 6, which are poured or packed into the casing above wad 4, and the crimping or seal 7.

Figure 2:
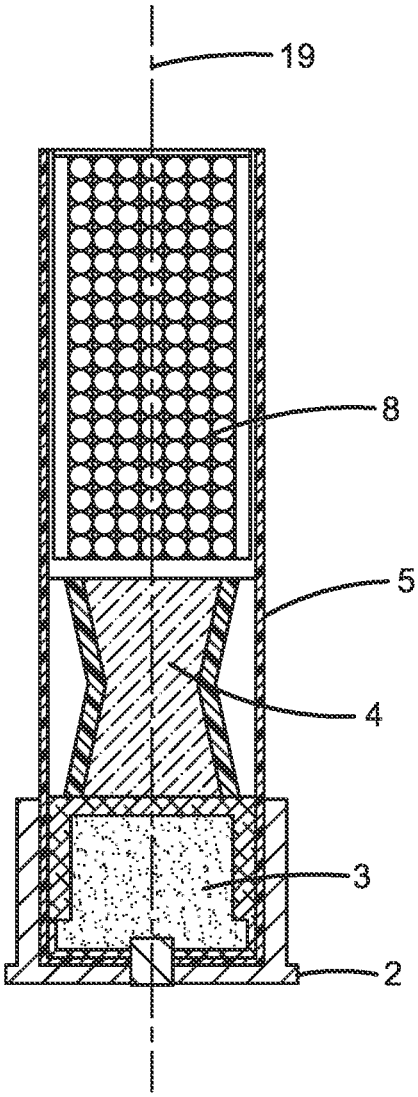
FIG. 2 is a side cross-sectional view of an exemplary shotshell embodiment of the present invention.

FIG. 2 shows an exemplary embodiment of the present improved shotshell invention with a payload carrier 8. It includes the primer 1, the metal base 2, the propellant 3, the wad 4, the hull or casing 5, and shot 6, stored in the payload carrier 8. The shotshell is closed at the top end by any method known in the art. The crimping or seal is not shown in this view to better illustrate the arrangement of the chambers that are clustered to form the payload carrier 8. The base 2 seals the bottom of the casing and contains the primer 1, which is in contact with the propellant 3. The base 2 is typically metal, such as brass, but any known base in the art can be used. The wad 4 is disposed above the propellant 3. When fired, the wad 4 deforms or crushes, and the payload carrier 8 and contained shot 6 burst through the top seal and travel down the barrel of the firearm.

Figure 3:
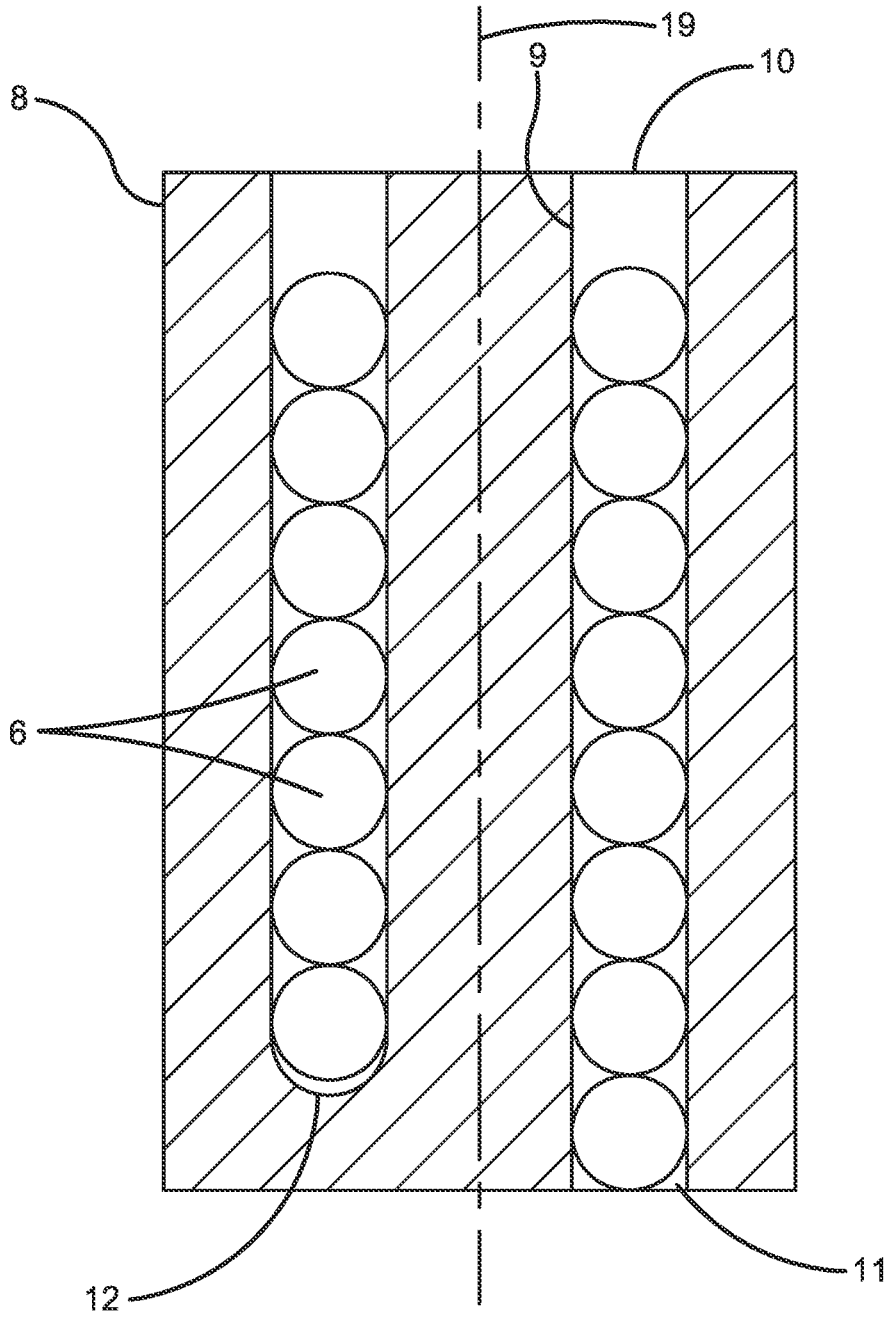
FIG. 3 is a cross-sectional view of an exemplary payload carrier with shot.
Figure 4:
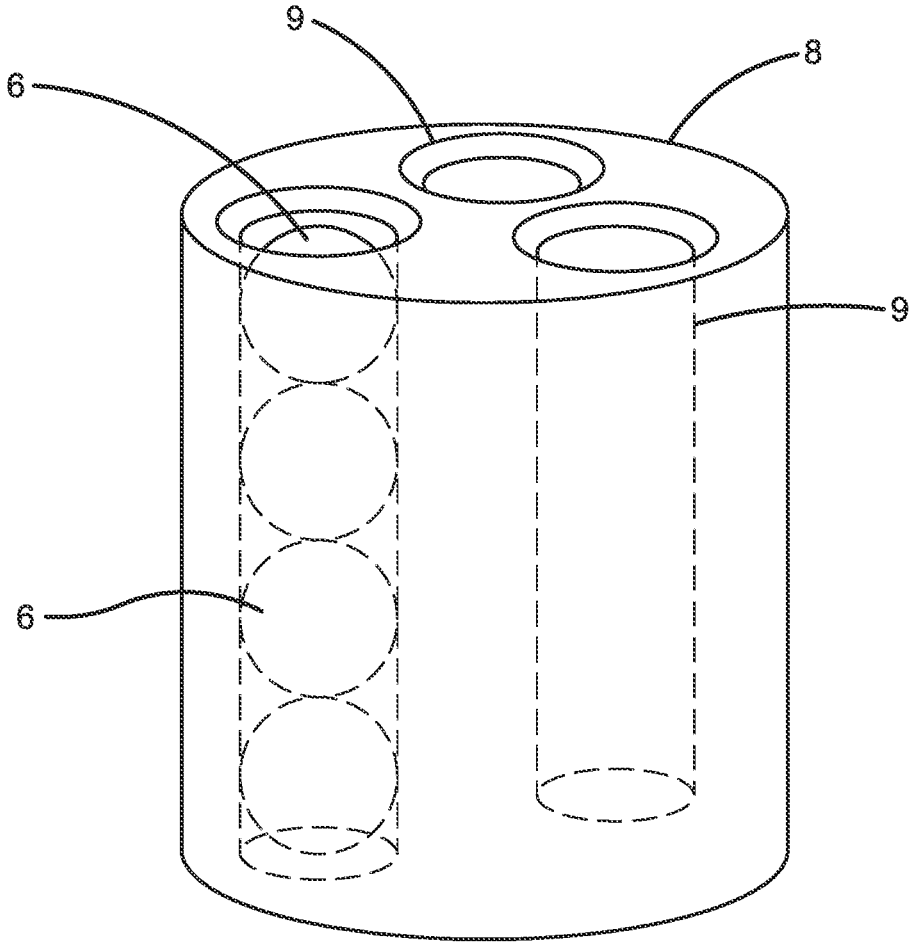
FIG. 4 is a perspective view of an exemplary payload carrier with shot.
Figure 5:
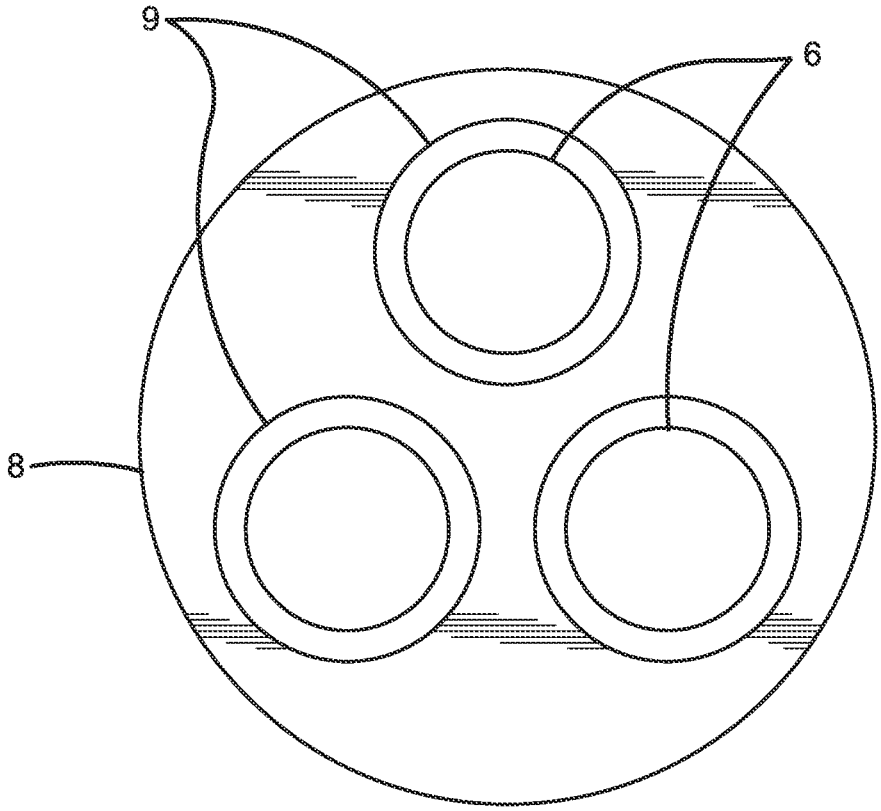
FIG. 5 is a top view of the payload carrier and shot of FIG. 4.

FIG. 3 shows a cross section of an exemplary payload carrier 8 with shot 6. FIG. 4 shows a perspective view of an exemplary payload carrier 8 with shot 6. FIG. 5 is a top view of the payload carrier 8 of FIG. 4. The payload carrier 8 includes one or more longitudinal chambers 9 that extend the length of the payload carrier 8 and hold the shot 6. The shot 6 stacked in a single file column aligned along, or parallel to, a longitudinal axis 19 of the shotshell. When chambered in a firearm, the longitudinal axis 19 of the shell coincides with the central longitudinal axis of the barrel. FIG. 3 depicts two chambers 8, and FIG. 5 depicts three chambers 8, but this is for case of illustration only, and the chambers 8 are not limited to two or three in number. The shotshell of the present invention can also include as few as a single (1) chamber, or two or more chambers. The smaller the shot pellet diameter, the more chambers can be included in a payload carrier; larger size pellets will result in fewer chambers.

The chambers 9 can have both ends open, such that a chamber 9 is a through-hole in the payload carrier 8. In this arrangement, the distal end 10 of the chamber is disposed at the top of the payload carrier, at or near the top of the casing, and a proximal end 11 is disposed toward the bottom the payload carrier, toward the wad 4 and propellant 3.

In another embodiment, the chambers 9 can have one open end and one closed end, such that a chamber 9 is a long cup in the payload carrier 8. In this arrangement, the distal end 10 of the chamber is open and disposed at the top of the payload carrier, at or near the top of the casing, and a proximal end 11 is closed/plugged/sealed and disposed toward the bottom the payload carrier, toward the wad 4 and propellant 3.

Figure 6:
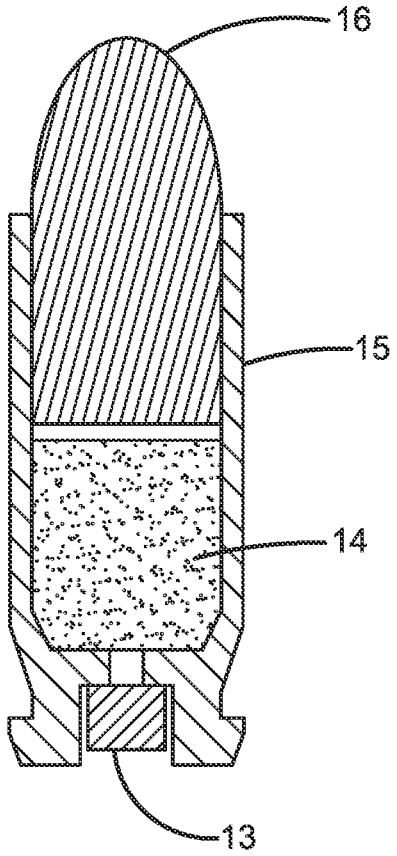
FIG. 6 Prior Art
FIG. 6 is a side cross-sectional view of a standard metal cartridge.

FIG. 6 shows a cross section of a standard metal cartridge. The essential parts of the standard metal cartridge are the primer 13, the propellant 14, the casing 15, and the bullet 16.

Figure 7:
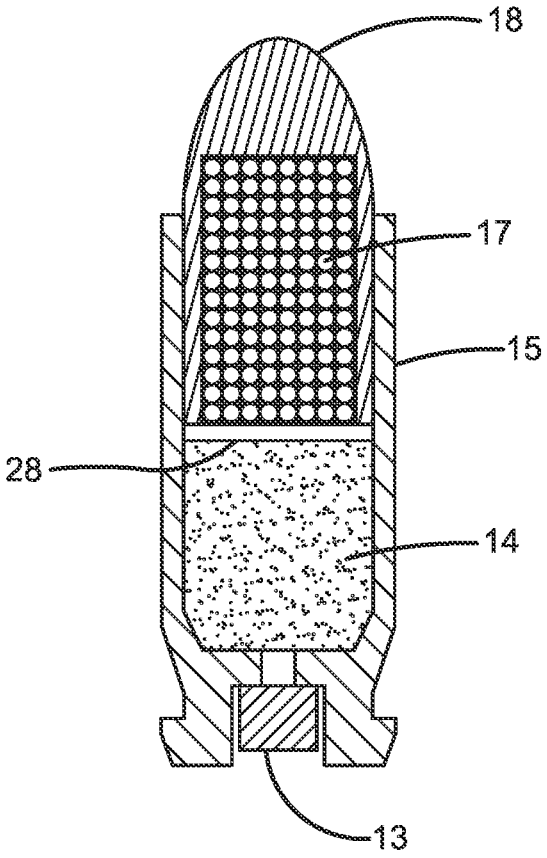
FIG. 7 is a side cross-sectional view of an exemplary metal cartridge embodiment of the present invention.

FIG. 7 shows a cross section of an exemplary metal cartridge with a payload carrier (i.e. a 3-part bullet). It includes the primer 13, the propellant 14, the casing 15, the payload carrier 17, and the hollowed bullet 18. An over-powder card 28 is disposed between the propellant and the payload carrier 17, which acts as an obturator. As shown in FIG. 8A, the shot 6 is inserted into the payload carrier 17, and the shot+payload carrier combination is inserted into the hollow bullet 18.

Figure 8:
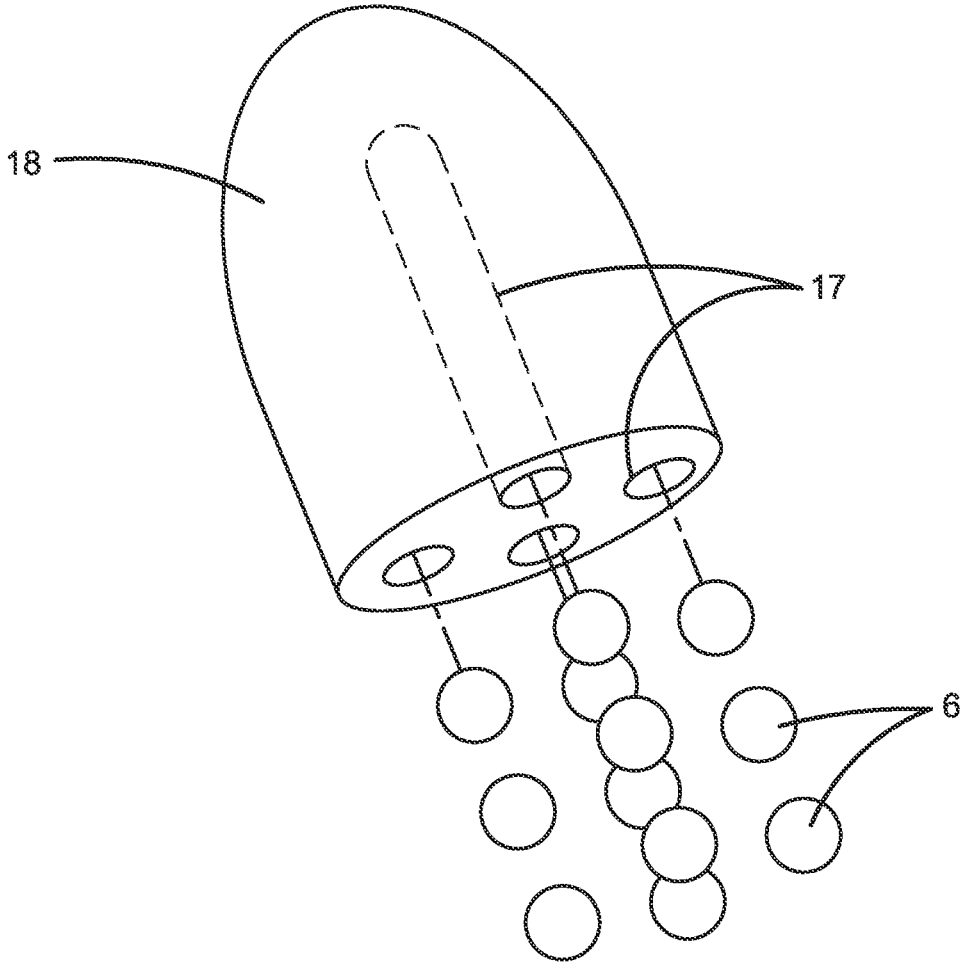
FIG. 8 is an exploded view of an exemplary metal cartridge.
Figure 8A:
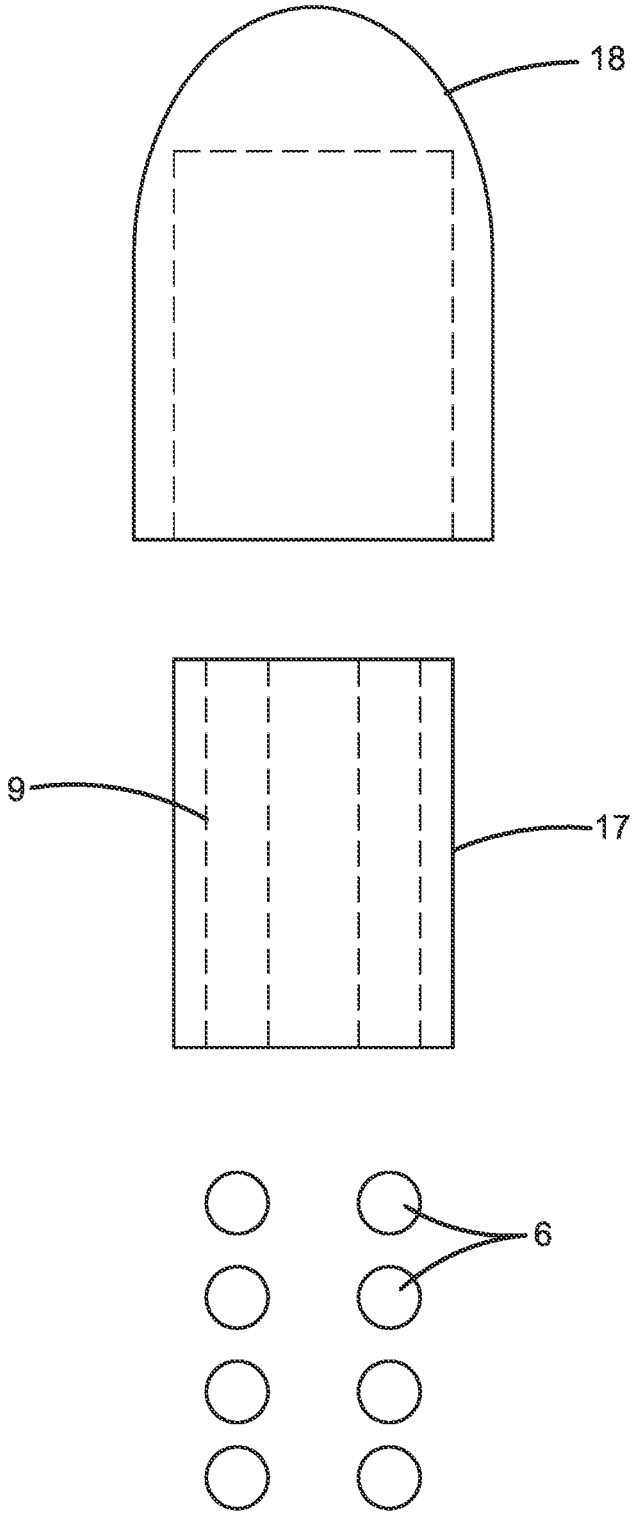
FIG. 8A is an exploded view of an alternate embodiment of an exemplary metal cartridge.

FIG. 8 shows an exemplary 2-part bullet, wherein the shot 6 is inserted directly into the back/underside of the hollowed bullet 18. The chambers 17 are fitted or lined with harder metal (e.g. brass, not shown) than the bullet (e.g. lead).

Figure 9:
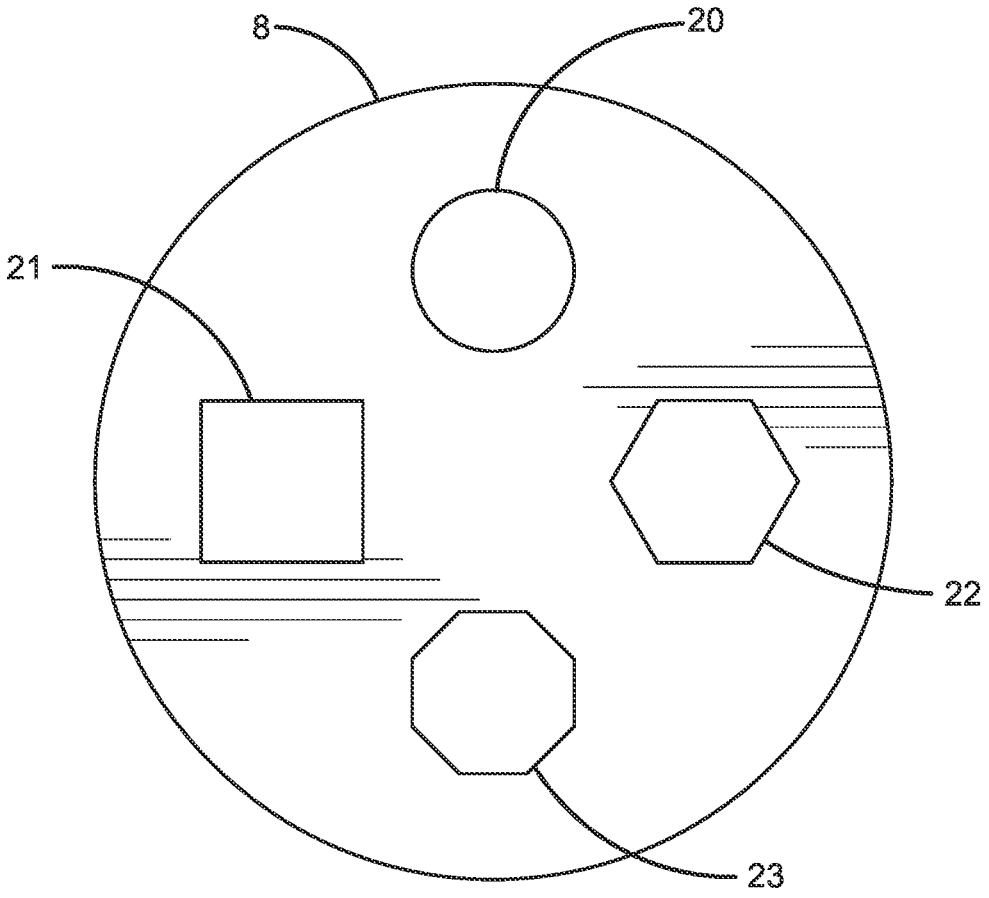
FIG. 9 is a top view of an exemplary payload carrier showing various alternate geometric embodiments of the chambers.

The chambers 9 are tubes or hollow prisms. They have been illustrated herein as cylindrical (i.e. a tube with a cross-sectional shape of a circle) for ease of illustration but are not limited to cylindrical. As shown in FIG. 9, the chambers 9 can have various cross-sectional shapes, including but not limited to circular (circle) 20, triangular (triangle), rectangular (square) 21, hexagonal (hexagon) 22, octagonal (octagon) 23. The different shapes 20-23 can provide additional rigidity to the payload carrier 8 and/or aid in case of manufacture, but the chambers 9 perform the same function regardless of cross-sectional shape.

Figure 10:
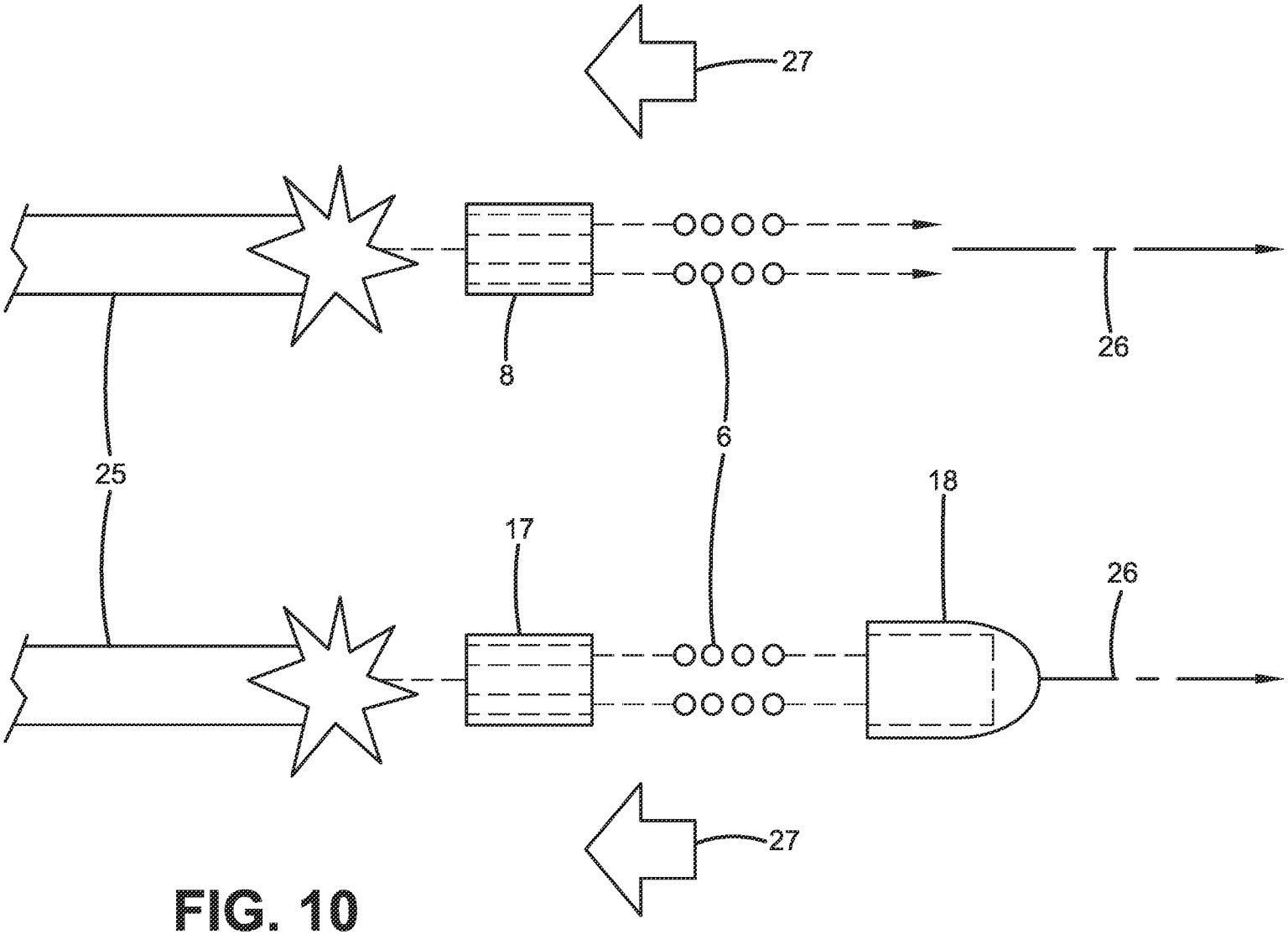
FIG. 10 is a side view showing an exemplary shotshell in use.

FIG. 10 shows an exemplary shotshell in use. The user pulls the trigger of the firearm, causing the firing pin to strike the primer, causing the propellant to explosively expand, forcing the wad, payload carrier and shot out of the barrel. The payload carrier 8 containing the shot 6 exits the barrel 25 of the firing platform. The payload carrier 8 separates from the shot 6 due to inertia and/or greater aerodynamic drag 27 on the payload carrier 8 than on the shot 6. The shot 6, having greater density and smoother shape than the payload carrier 8, decelerate at a slightly lesser rate than the payload carrier 8, and separate from the payload carrier 8, while continuing to move forward along the same ballistic trajectory 26. Because the payload carrier 8 has kept the shot 6 in single-file line and prevented the shot 6 from mixing with gasses and bouncing off the inside surface or the barrel (and bounding off other shot), the shot 6 stay in a tighter spread compared to traditional shotgun firing patterns.

Also shown in FIG. 10 is a hollow bullet embodiment using a payload carrier and shot. The user pulls the trigger of the firearm, causing the firing pin to strike the primer, causing the propellant to explosively expand, forcing the payload carrier and bullet out of the barrel. The payload carrier 17 containing the shot 6 exits the barrel 25 of the firing platform. The payload carrier 17 separates from the bullet 18 due to inertia and/or greater aerodynamic drag 27 on the payload carrier 17 than on the bullet 18. The payload carrier 17 separates from the shot 6 due to inertia and/or greater aerodynamic drag 27 on the payload carrier 17 than on the shot 6. The shot 6, having greater density and smoother shape than the payload carrier 17, decelerate at a slightly lesser rate than the payload carrier 17, and separate from the payload carrier 17, while continuing to move forward along the same ballistic trajectory 26. The bullet 18, having a greater density and mass than the shot 6 and payload carrier 17, decelerates at a slightly lesser rate and continues to move forward along the same ballistic trajectory 26. Because the payload carrier 17 has kept the shot 6 in single-file line and prevented the shot 6 from mixing with gasses and bouncing off the inside surface or the barrel (and bouncing off other shot), the shot 6 stay in a tighter spread compared to traditional shotgun firing patterns.

Figure 11:
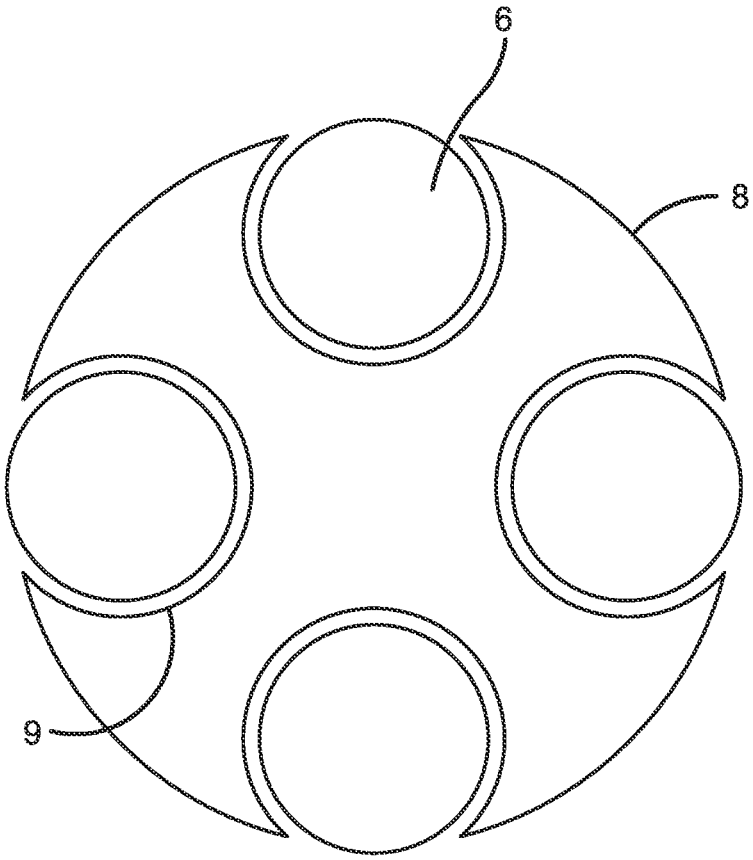
FIG. 11 is a top view of an alternate embodiment of an exemplary payload carrier.

FIG. 11 shows an alternate embodiment of an exemplary payload carrier 8 configured to have the chambers 9 disposed as slots along the edge of the payload carrier 8. The shot 6 will contact the barrel, but because the shot is not bouncing of other shot and/or the barrel, the shot does not damage the barrel.

Figure 12:
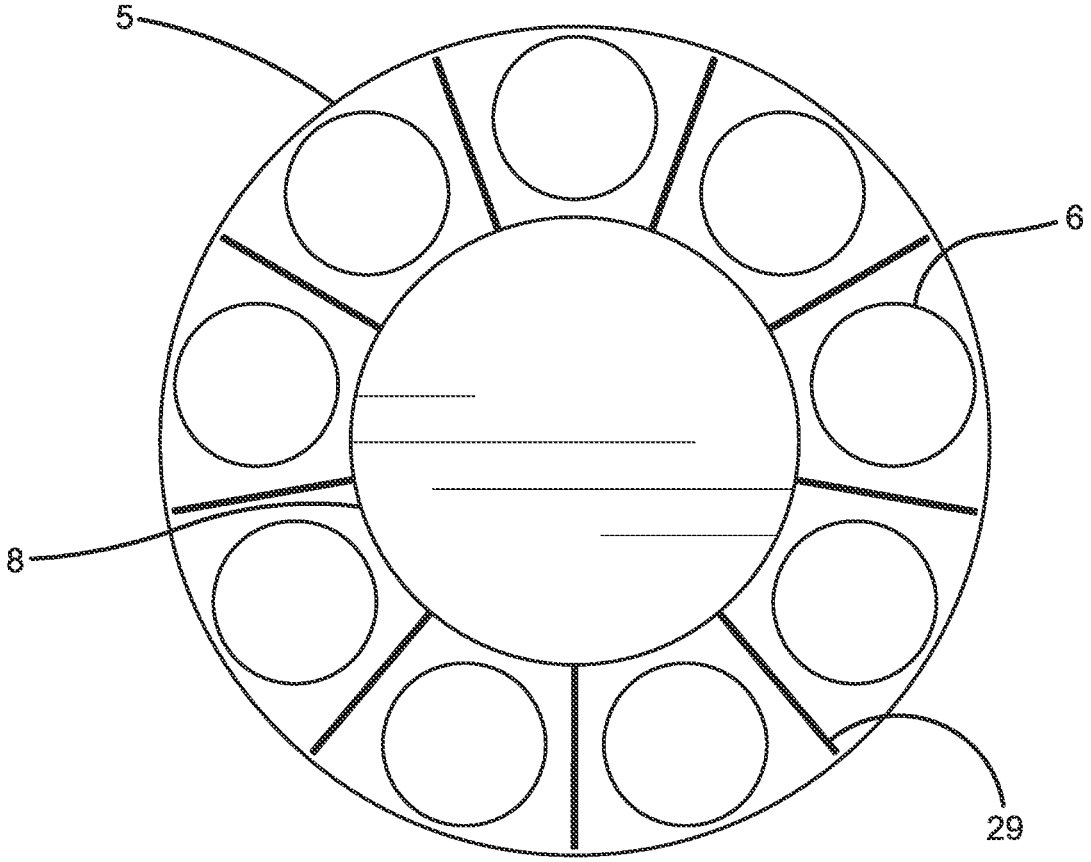
FIG. 12 is a top view of an alternate embodiment of an exemplary payload carrier.
Figure 13:
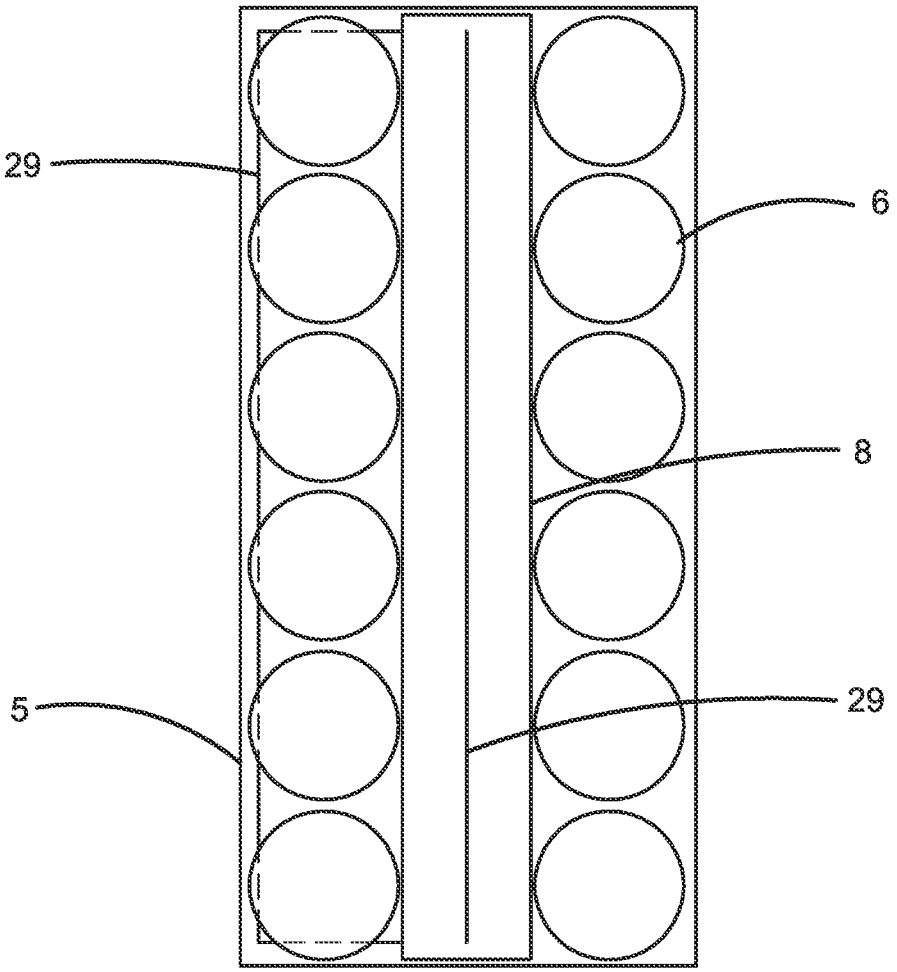
FIG. 13 is a side view of the payload carrier of FIG. 12.

FIGS. 12 and 13 show an alternate embodiment of an exemplary payload carrier 8 configured as a central rod with a plurality of fins 29 extending radially outwards. The fins 29 in combination with the casing 5 define a plurality of spaces or chamber that can each hold a portion of the shot in a stack or column of single file shot 6. The shot 6 will contact the barrel, but because the shot is not bouncing off of other shot and/or the barrel, the shot does not damage the barrel. The central rod/payload carrier 8 acts as a slug or projectile. The rod/slug/payload carrier 8 can have a rounded/bullet-shaped tip and/or include additional stabilizing fins, such as a flechette.

Many parts of this exemplary embodiment, like many other inventions, can have all the parts manipulated into different lengths, widths, and heights not proportional to all of the figures provided. While not being proportional all elements can still be configured to be the perform the same basic principal function. This must be particularly pointed out for this type of invention due to the nature of the invention, needing to accommodate different firing platforms and barrels.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something and is not intended to indicate a preference.

Although the invention has been shown and described with respect to a certain embodiment or embodiments, equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

While example systems, methods, and so on, have been illustrated by describing examples, and while the examples have been described in considerable detail, it is not the intention of the applicants to restrict or in any way limit scope to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

What is claimed is:

1. A shotshell comprising:

a casing having a top end and bottom end, and a longitudinal axis that runs from the top end to the bottom end;

a base disposed at and sealing the bottom end of the casing;

a propellant disposed toward the bottom end of the casing, above the base;

a primer set into the base and in contact with the propellant;

a wad disposed above the propellant;

a plurality of shot pellets;

a payload carrier disposed between the wad and the top end of the casing, the payload carrier comprising two or more longitudinal chambers, each chamber configured to store a portion of the plurality of shot pellets in a single file column aligned parallel to the longitudinal axis of the casing.

2. The shotshell of claim 1, wherein when inserted into a firearm and fired, the primer ignites the propellant, forcing the wad, payload carrier, and shot out of a muzzle of the firearm, wherein, after exiting the muzzle, the shot exit the payload carrier through open ends of the chambers, outrun the payload carrier, and follow a ballistic trajectory downrange.

3. The shotshell of claim 1, wherein each of the two or more longitudinal chambers have a distal open end disposed toward the top end of the casing and a proximal open end disposed toward the propellant.

4. The shotshell of claim 1, wherein each of the two or more longitudinal chambers have a distal open end disposed toward the top end of the casing and a proximal closed end disposed toward the propellant.

5. The shotshell of claim 1, wherein the plurality of shot pellets comprises pellets of varying diameters.

6. The shotshell of claim 1, wherein the two or more longitudinal chambers have a cross-sectional shape selected from circular, triangular, square, hexagonal, and octagonal.

7. The shotshell of claim 1, further comprising a hollow bullet disposed between the payload carrier and the top end of the casing.

8. The shotshell of claim 1, wherein the payload carrier is nonlethal.

9. The shotshell of claim 1, wherein the shot pellets comprise less-than-lethal pellets.

10. The shotshell of claim 1, wherein the wad and payload carrier comprise a single unit.

11. A cartridge comprising:

a casing having a top end and bottom end;

a hollowed bullet disposed in and sealing the top end of the casing;

a base disposed at and sealing the bottom end of the casing;

a propellant disposed toward the bottom end of the casing, above the base;

a primer set into the base and in contact with the propellant;

an overpowder card disposed above the propellant;

a plurality of shot pellets;

a payload carrier disposed between the overpowder card and extending into the hollowed bullet, the payload carrier comprising two or more longitudinal chambers, each chamber sized to store a portion of the plurality of shot pellets in a single file column aligned parallel to a longitudinal axis of the casing.

* * * * *